United States Patent [19]

Curiel

[11] Patent Number: 5,028,290

[45] Date of Patent: Jul. 2, 1991

[54] METHOD OF APPLYING A TAMPER EVIDENT LABEL TO A PACKAGE AND ASSOCIATED APPARATUS

[75] Inventor: Yoram Curiel, Aurora, Colo.

[73] Assignee: TSL Incorporated, Evergreen, Colo.

[21] Appl. No.: 347,469

[22] Filed: May 4, 1989

[51] Int. Cl.[5] ..... B65C 3/00; B65C 9/00

[52] U.S. Cl. ..... 156/232; 156/238; 156/242; 156/249; 156/273.5; 156/275.5; 156/361; 156/362; 156/363; 156/541; 156/542; 156/568

[58] Field of Search ..... 156/275.5, 273.5, 238, 156/232, 568, 344, 361, 541, 542, 249, 387, 362, 363, 242; 264/509, 22, 297.3

[56] References Cited

U.S. PATENT DOCUMENTS

| | | | |
|---|---|---|---|
| 1,664,635 | 4/1928 | Magill . | |
| 2,074,490 | 3/1937 | Schwartz . | |
| 2,127,548 | 8/1938 | Boyle et al. . | |
| 2,131,774 | 10/1938 | Waring . | |
| 3,415,402 | 12/1968 | Webber . | |
| 3,662,915 | 5/1972 | Destler, Jr. . | |
| 3,666,591 | 5/1972 | Hall | 156/273.5 |
| 3,783,089 | 1/1974 | Hurst et al. . | |
| 3,786,777 | 1/1974 | Smith et al. . | |
| 3,935,960 | 2/1976 | Cornell . | |
| 4,012,553 | 3/1977 | Clemens . | |
| 4,098,577 | 7/1978 | Halpern . | |
| 4,181,223 | 1/1980 | Millett . | |
| 4,253,899 | 3/1981 | Takemoto et al. | 156/184 X |
| 4,424,252 | 1/1984 | Nativi . | |
| 4,436,203 | 3/1984 | Reyner . | |
| 4,449,632 | 5/1984 | Marusiak, Jr. . | |
| 4,451,523 | 5/1984 | Nativi et al. . | |
| 4,479,585 | 10/1984 | Sandhaus . | |
| 4,502,605 | 3/1985 | Wloszczyna . | |
| 4,505,399 | 3/1985 | Weiner . | |
| 4,516,679 | 5/1985 | Simpson et al. . | |
| 4,546,881 | 10/1985 | Tasma . | |
| 4,566,627 | 1/1986 | Gendron . | |
| 4,576,297 | 3/1986 | Larson . | |
| 4,668,327 | 5/1987 | Voltmer et al. | 156/542 X |
| 4,718,553 | 1/1988 | Adamoli et al. . | |
| 4,747,499 | 5/1988 | Gach et al. . | |
| 4,749,084 | 6/1988 | Pereyra . | |
| 4,759,445 | 7/1988 | McVay . | |

*Primary Examiner*—David A. Simmons
*Assistant Examiner*—Thi Dang
*Attorney, Agent, or Firm*—Arnold B. Silverman; David V. Radack

[57] ABSTRACT

A method of applying a tamper evident label to a package including the steps of depositing a liquid resin on a carrier tape and then treating the liquid resin to produce a label having an adhesive portion. The label is separated from the carrier tape and the adhesive portion is secured to the package. The label is then cured to create a tamper evident label on the package. An associated apparatus is also provided.

4 Claims, 3 Drawing Sheets

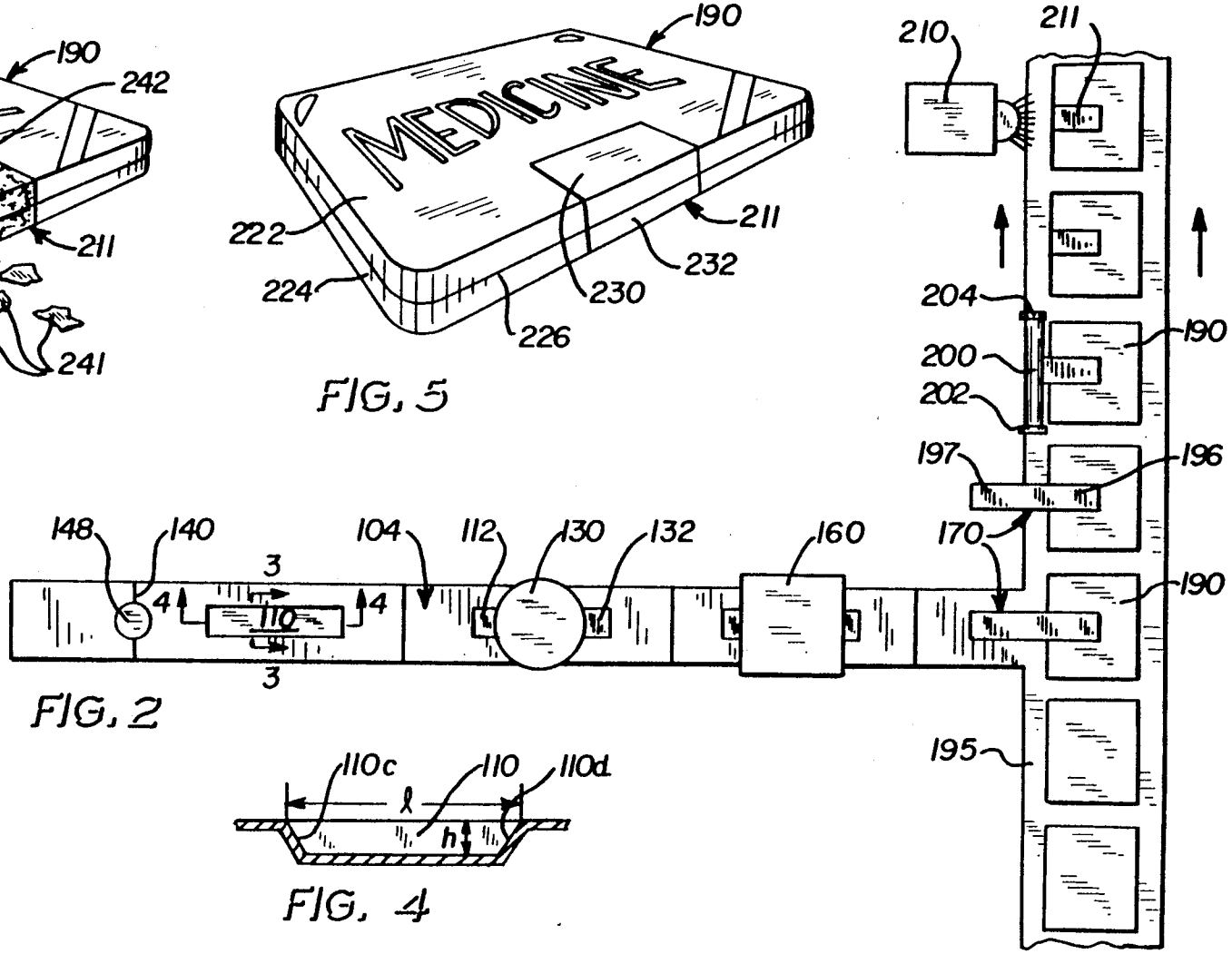
FIG. 2
FIG. 4
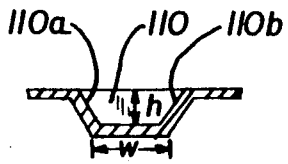
FIG. 3
FIG. 5
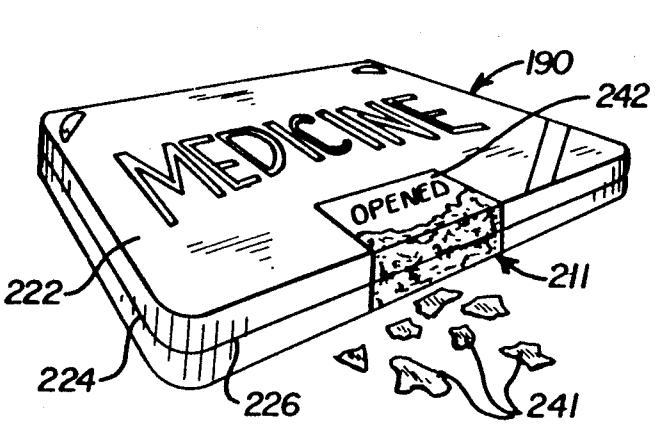
FIG. 6

METHOD OF APPLYING A TAMPER EVIDENT LABEL TO A PACKAGE AND ASSOCIATED APPARATUS

BACKGROUND OF THE INVENTION

1. Field of the Invention

This invention relates to a method of applying a tamper evident label to a package and an associated apparatus, and more specifically to a method and apparatus that facilitates placement of such a label on a precise location of a package.

2. Description of the Prior Art

The tampering with and adulteration of many commercially available products have become critical problems endangering health and destroying purity of many products. Many products which are adulterated or tampered with ultimately reach a consumer bearing no visible indication that such adulteration or tampering has occurred. Accordingly, it is highly desirable to provide a type of packaging which would give a reliable visual indication that there has been interference with the integrity of the product packaging.

My earlier U.S. patent application Ser. No. 07/209,822 filed June 22, 1988, the disclosure of which is expressly incorporated herein by reference, discloses a tamper resistant package and a method of making the same. An outer protective layer of an epoxide resin is placed on a package and is subsequently cured by ultraviolet radiation. This causes the outer layer to become extremely brittle such that any physical penetration of the outer layer will cause the outer layer to shatter. Such shattering will provide a clear visual indication that penetration of the protective layer has occurred as by cracking of the material and separation of the pieces from the package. The methods specifically disclosed for coating the package are (i) dipping the package in the coating material, (ii) spraying the package with the coating material or (iii) brushing the package with a brush or other means containing the coating material.

U.S. Pat. No. 2,131,774 discloses a closure including a sealing liner. A disc of fibrous material is placed between the closure and the sealing liner. When the closure is removed, the disc will rupture the closing liner. See also, U.S. Pat. Nos. 4,576,297 and 4,747,499.

It has been known to provide outer coatings which fracture responsive to operation of a tear strip. See U.S. Pat. No. 3,415,402. See also U.S. Pat. No. 4,479,585.

U.S. Pat. No. 2,074,490 discloses a tamperproof container having a composite consisting of a heat sensitive paint, printing ink and varnish. This composite is coated on the entire container.

U.S. Pat. No. 4,546,881 discloses an elastomeric material which protectively surrounds a container. The process of placing the material on the container involves providing a sheet of the material and placing both the sheet and the container in a vacuum mold. The package is then lowered into the mold and the sheet is tied around the package. Excess material is cut from the packaging material by blades.

In spite of these prior art teachings, there remains a need for an effective method and an associated apparatus for creating a tamper evident package having a coating material disposed on a precise location on a package. There remains a need for such a method and apparatus that can be employed on different shapes and sizes of packages.

SUMMARY OF THE INVENTION

The method of the invention includes depositing a liquid resin on a carrier tape and then treating the liquid resin to produce a label having an adhesive portion. The label is separated from the carrier tape and the adhesive portion is secured to the package. The label is then cured to create a tamper evident label on the package. An associated apparatus is also provided.

It is object of the invention to provide an efficient method and apparatus for applying a tamper evident label to a precise location on a critical area of the package.

It is a further object of the invention to reduce the amount of coating material used on a tamper-protected package.

It is a further object of the invention to provide such a system which is employable with a wide variety of package shapes, sizes and designs.

It is further object of the invention to apply the resin to an area of a package which already contains text or graphics.

It is a further object of the invention to provide a carrier tape in the form of an endless conveyor loop that can be reused.

It is further object of the invention to provide such a system which is usable with ultraviolet ray curing materials.

It is a further object of the invention to apply the resin to a label and then applying the label and resin to the package.

These and other objects of the invention will be fully understood from the following description of the invention with reference to the drawings appended to this application.

BRIEF DESCRIPTION OF THE DRAWINGS

FIG. 2 is a schematic top plan view of the apparatus of the invention.

FIG. 3 is a cross-sectional view of a portion of the tape of FIG. 2 taken through line 3—3 of FIG. 2.

FIG. 4 is a cross-sectional illustration of the of FIG. 2 taken through line 4—4 of FIG. 2.

FIG. 5 is a perspective view of a package which has the label composite placed on a particular location by the method and apparatus of the invention.

FIG. 6 is the package of FIG. 5 showing what happens to the tamper evident label when tampering with the package has occurred.

DESCRIPTION OF THE PREFERRED EMBODIMENT

Figure 1:
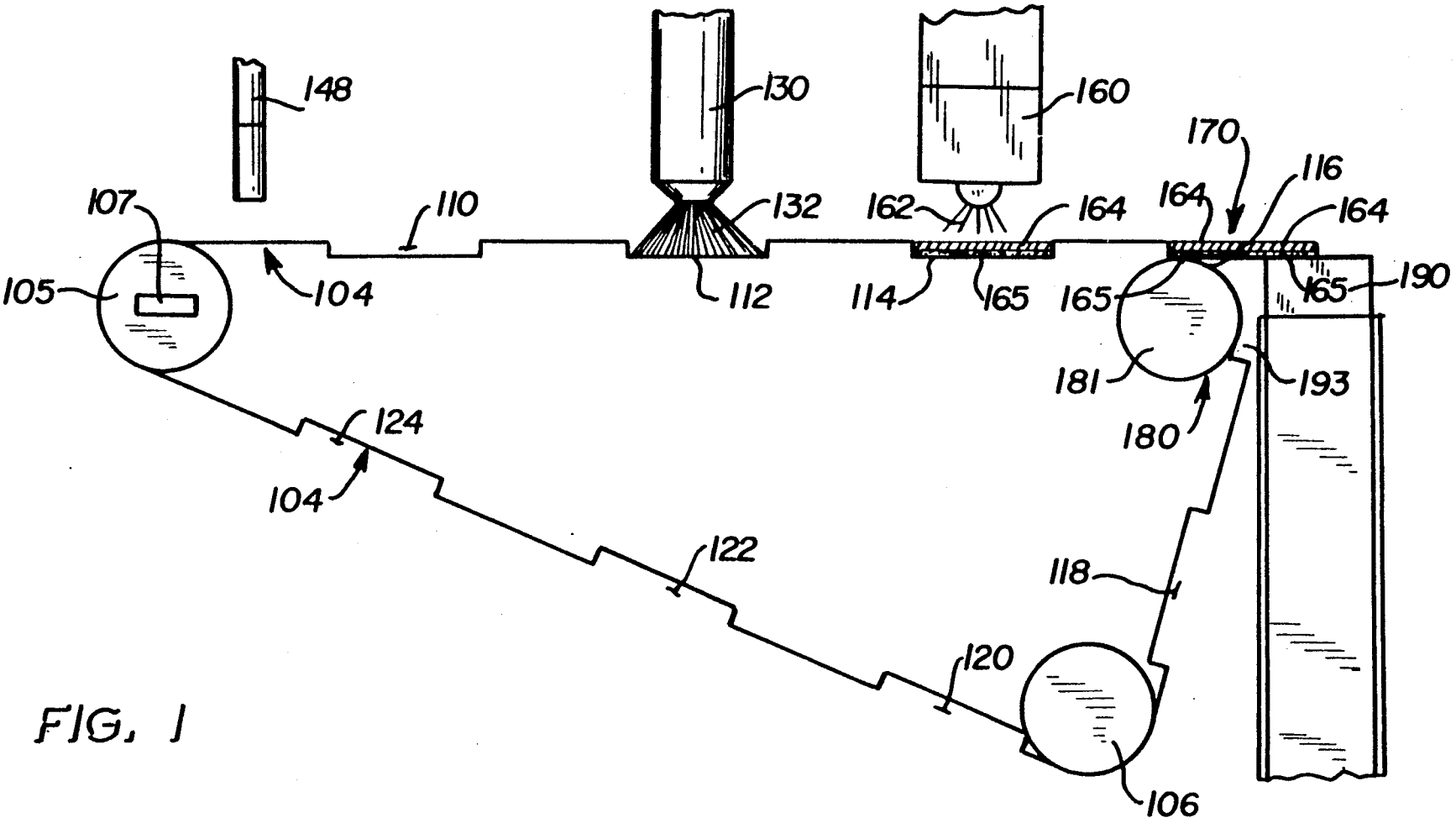
FIG. 1 is a schematic side elevational view of the apparatus of the invention.

A method and apparatus of the present invention of applying a tamper evident label to a package will be discussed with reference to FIGS. 1 and 2. The tape 104 of the invention is shown in the form of an endless conveyor belt. The tape 104 is driven by roll 105 which is powered by a suitable electrically energized motor 107. The tape 104 travels over idler roller means 181 and over idler roll 106 to return to powered roll 105. It will be appreciated that an alternate, but less preferred approach, would involve providing a long running take-off spool of tape at the location of roll 105 which would travel over an idler roller means such as 181 and which could then be taken-up on a suitable take-up roller positioned as is roll 106.

The tape 104 can be made from a releasable type plastic material such as tetrafluorethylene, silicon or Mylar, which is a trade designation for polyester. The composition of the tape 104 will depend on the type of coating material that is used and the specific needs of the particular package that is to be made tamper evident. The tape 104 can have a length of about 50 to 200 yards and can be 0.5 to 3.0 inches wide and 0.01 to 0.1 inches thick, for example.

The tape 104 is provided with a series of recesses 10, 112, 114, 116, 118, 120, 122, and 124, for example. These recesses, which are shown as having a longitudinally oriented generally rectangular shape, can be formed in any desired shape and any desired length, width or height. The recesses are preferably equally spaced from each other with any desired distance between recesses being used. The recesses can be produced on line or in advance of placing the tape in the form of the endless conveyor belt shown in FIG. 1. Different textures and shapes, such as stars or grooves can be provided in the recess itself to create different types of coating material shapes and textures. The depth of the recess will conform to the thickness of the label applied to the package. The recess can be individually treated with a releasable type plastic material such as tetrafluorethylene or silicon. This will facilitate separation of the resin from the tape as will be explained hereinbelow.

A typical recess such as recess 110 is shown further in FIGS. 3 and 4. The recess can have a depth "h" of about 2 to 12 mils with about 3 to 10 mils being preferred. The length "l" (FIG. 4) is about $\frac{1}{4}$ to $2\frac{1}{4}$ inches with about $\frac{3}{8}$ to $1\frac{1}{4}$ inches being preferred. The width "w" (FIG. 3) is about $\frac{1}{4}$ to $1\frac{1}{4}$ inches with about $\frac{3}{8}$ to $\frac{7}{8}$ inches being preferred. Recess 110 is shown with slightly tapered sides 110*a*, 110*b*, 110*c*, and 110*d*. It will be appreciated that all, some or none of the respective sides of the recesses can be tapered or straight.

Referring again to FIGS. 1 and 2, the tape 104 is conveyed underneath a metered resin dispenser 130. The dispenser 130 deposits a measured amount of uncured resin 132 into each upwardly open recess. A suitable metered resin dispenser 130 can be an electronic valve marketed under the trade name "Foam Melt 130" by Nordson or an electronic valve manufactured by Krones, Inc. The resin dispenser 130 contains a supply of a molten resin 132, as, for example, one of the resins disclosed in my application Ser. No. 07/209,822. The resin 132 can have different tints or colors depending on the desired application.

Preferably, the resin 132 includes an epoxide resin such as a cycloaliphatic epoxide manufactured by Union Carbide Corp. of Danbury, Conn., and sold under the trade designation Envibar 1244. Alternatively, the resin could include a polyester base ultraviolet cured matte sold under the trade designation Polycure by Oriental Intl. of Tokyo, Japan, for example. As another alternative, a premixed ultraviolet light curable acrylate may be used such as, for example, those sold by Loctite Corporation in Newington, Conn. A combination of the above materials can be used as well.

Cycloaliphatic epoxide products such as those mentioned hereinbefore, are low-viscosity, miscible liquids that are easily combined. In order to obtain the appropriate properties with those materials, the resin 132 should include photoinitiators. The process of this combination is sometimes referred to as "formulation". A suitable class of materials are the onium salt photoinitiators, sold under the trade designations CYRA CURE EVI-6974 and CYRA CURE UVI-6990 by Union Carbide Corp. and UVE-1014 and UVE-1016 by General Electric Company. More specifically, the cationic chemistry involved in the curing of adhesives, coatings, inks, and sealants deals with onium salt photoinitiators. These photoinitiators are blocked catalysts that are unblocked by the action of ultraviolet light. When the salts are exposed to ultraviolet light, they photolyze and chemically decompose under the action of ultraviolet light. Subsequently, they generate into a cationic species that acts as a catalyst or an initiator for polymerization of cycloaliphatic epoxides. In the presence of the generated cationic species, very rapid polymerization takes place.

The Envibar 1244 material is a general purpose base epoxide that has an excellent cure response and viscosity differentiation that facilitates formulation. Epoxide materials respond to ultraviolet light cure when they are combined with an appropriate photoinitiator. Aryldiazonium salts and arylidonium salts are suitable photoinitiators. When the base epoxides, such as UVR 6110, are used alone as the only polymerizing ingredient in a formulation, hard, brittle coatings with good solvent resistance and adhesion result. This result is desirable for purposes of the present invention.

In order to prepare the formulation, the various ingredients may be simply combined or stirred by simple mixing for a suitable period, and then the coating and curing procedures are undertaken. The process should preferably be carried out under "yellow" light conditions to protect the preparation from ultraviolet light until curing is performed.

If desired, a material already containing the photoinitiator may be employed. One suitable material for this purpose is that sold by Union Carbide under the trade designation ENVIBAR 1244. Another suitable material that can be used is acrylate because of its ability to be cured by short bursts of ultraviolet radiation in a short period of time.

The tape 104 must stop periodically for a predetermined period in order for the recesses to be filled by the dispenser 130. This may be accomplished by providing indicia 140 (FIG. 2) on the tape 104 which can be scanned by an optical reader 148. The optical reader 148 sends a signal to the powered roll 105 which causes the motor 107 to stop or start so that sequential movement of the tape 104 is accomplished. Optical controls are widely available from numerous sources such as BWI of Clearwater, Fla. or Omron of Chicago, Ill.

After the recess is provided with a predetermined amount of resin 132, the tape 104 is conveyed past a first ultraviolet curing exposing device 160. A suitable device is a 10 or 12 inch ultraviolet 1,000 watt or 2,000 watt tube, water cooled, made by Photocure, Inc. of Indianapolis, Ind. This device 160 delivers the desired amount of radiation to effect an amount of ultraviolet radiation 162 in the range of 5 to 50 wp/inch$^2$.

An alternative light source is one that irradiates the resin 132 with xenon light. A suitable xenon light source is Model No. RC 500 made by Xenon Corporation of Woodburn, Mass. Xenon light does not generate heat on the product and can be delivered in short and very intense bursts.

The resin 132 is partially cured so that a tackfree, dry, top layer 164 of resin is created while the lower part 165 of the resin, which is in contact with the tape 104, retains its adhesiveness. This partial curing creates sufficient resiliency within the resin such that when the carrier tape 104 goes around idler roller 181 and makes a sharp turn, the semicured resin will remain straight (FIG. 2), separating from the tape 104, with the adhesive lower part 165 adhering to the package. This method produces a self-adhering label which also does not spill from the recess as the tape 104 moves through the remaining steps of the process and such that the resin does not drip from a vertical position.

Referring particularly to FIGS. 1 and 2, the label 170 in recess 116 is now ready for application to the package. This may be accomplished by providing a sharp turn, as at 180, in the path of travel of the carrier tape 104. The sharp turn is provided by the position of the roll 106 which directs carrier tape 104 over idler roller means 181 such that the carrier tape 104 travels in a downward direction towards roll 106. This action causes the label 170 with adhesive end 165 and tack-free end 164 to continue to move in the direction of the tape 104 before the sharp turn 180. The label 170 is then received on the desired portion of the package 190 while at the same time, the now blank tape 193 continues down the line to roll 106.

It will be appreciated that the timing of the carrier tape 104 containing the label 170 and the conveyor 195 must be coordinated so that the package 190 reaches the label 170 separation point at the same time that the label 170 is separated from the carrier tape 104. Suitable drive and control means to accomplish this are well known to those skilled in the art.

Referring to FIG. 2, the package 190 along with other packages, is transported in the direction of the arrows on a conveyor 195 which may be an endless conveyor. As can be seen, part 196 of the label 170 is adhered to the package 190, and part 197 is protruding from the side of the package 190. The label 170 adheres to the package because the adhesive portion 165 of the label is placed on top of the package 190. Both parts 196 and 197 are adhered to the package 190 by providing an overlying swinging roller 200. The swinging roller 200 is spring loaded and is positioned over the package 190 by supports 202 and 204. The roller 200 moves up and down to urge both parts 196 and 197 of the label 170 into intimate bonding relationship with the package 190. Suitable rollers and control means for accomplishing placing the label 170 on the package are well known to those skilled in the art.

The label 170 on the package 190 will then be subjected to a second exposure to ultraviolet light by a second ultraviolet curing device 210 in order to create the tamper evident label 211. The second exposure cures the adhesive end 165 of label 170, and makes the resin hard and brittle. This second exposure is preferably much more powerful than the first, being about 50 to 250 watts per square inch. Such curing creates the tamper evident label 211 by establishing a bond between the resin material and the package which is preferably substantially continuous. The bond is preferably such that fracture of the brittle material will cause one or more sections thereof to become separated from the package and in at least some instances, fall off.

Because of the characteristics of the resin 132 and the carrier tape 104, substantially all of the resin 132 contained within the tape recess 116, for example, will be transferred to the packages. Any residual pieces of the resin remaining after transfer of the label to the packages fall off as cured pieces as the carrier tape 104 completes the sharp turn 180. If desired, a cleaning agent such as an air or liquid spray may be employed to further clean the tape 104.

Referring now to FIGS. 5 and 6, package 190 having a tamper evident label 211 applied according to the method of the invention will be discussed. The package 190 shown is a conventional container for medicines or the like and consists of a lid 222 hingedly connected to a base 224. A seam 226 is created between the lid 222 and the base 224. As can be seen, the tamper evident label 211 is placed so that one portion 230 overlies the lid 222 and another portion 232 overlies the base 224. The label 211 is bonded to the package so that portion 230 is generally perpendicular to portion 232. This, of course, will prevent opening the lid 222 without fracture of the resin. It will be appreciated that the resin and not any underlying legend is only visible to purchasers.

FIG. 6 shows what happens when the package is tampered with or otherwise opened. If tampering occurs, the tamper evident label 211 will break off into pieces 241, thus revealing underlying indicia 242 such as "OPENED" which warns the consumer that tampering has occurred. It will be appreciated that the indicia 242 may be printed in the same tint and color as the resin so that it is visible only after the label 211 breaks off the package. In the alternative, the resin may be a color that masks the indicia. It will be appreciated that any tampering, such as penetration by a needle to outright opening of the container, will cause the label 220 to break off into pieces 241. As was explained in my U.S. patent application Ser. No. 07/209,822, this provides irreversible evidence of tampering with or adulteration of the package.

Figure 7:
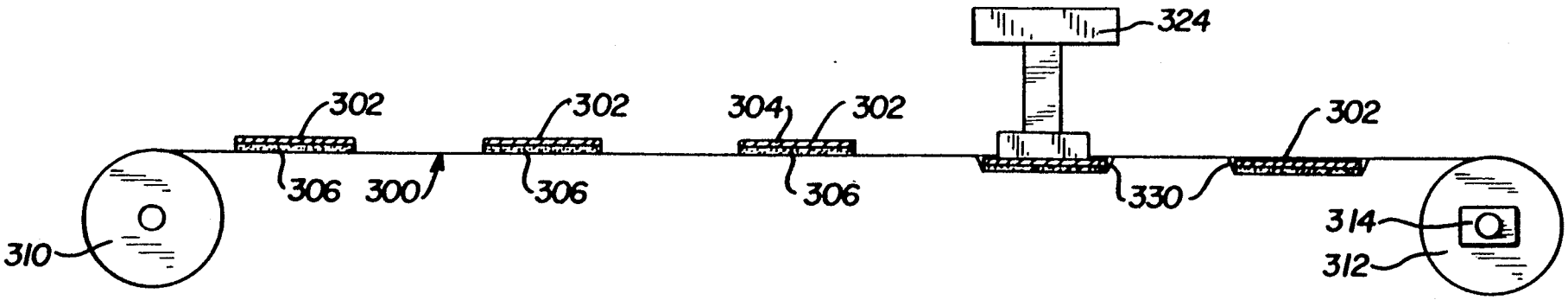
FIG. 7 is a schematic side elevational view showing the method and apparatus for preparing the tape having a label.
Figure 8:
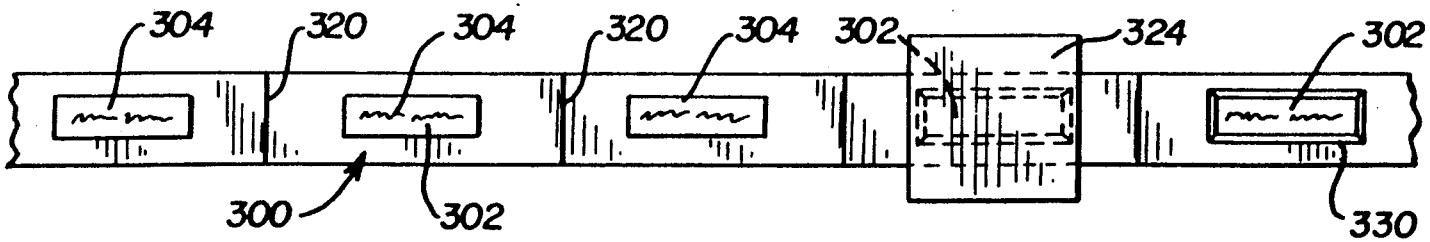
FIG. 8 is a top plan view of the tape of FIG. 7.

An alternative "off-line" embodiment of the carrier tape 300 is shown in FIGS. 7 and 8. A flat carrier tape 300 is provided, on which are placed a series of preprinted labels 302. The labels 302 are provided with a printed side 304 and an adhesive side 306. The adhesive side 306 is placed so that it contacts the tape 300. The carrier tape 300 is taken off from a take-off spool 310 and is wound onto a take-up spool 312 which is powered by a motor 314. The tape 300 contains similar optical separation marks 320, as were disclosed with respect to FIGS. 1 and 2.

The tape 300 with the label 302 is conveyed beneath a pressure applying mechanism, such as a press 324. This press 324 applies downward pressure on the label 302 to create a cavity 330 in which the label 302 is placed at the bottom. The tape 300, having the cavity 330 with a label 302 is then wound onto a take-up spool 312.

The take-up spool 312 can then be introduced to a similar production line as was described with respect to FIGS. 1 and 2. As described hereinbefore, the apparatus of FIGS. 1 and 2 can be used with a take-off spool and a take-up spool, as opposed to being a closed loop system. The take-up spool 312 is simply placed where spool 105 is placed in FIG. 1. The process then continues as was described hereinabove with respect to FIGS. 1 and 2.

As an alternative to using two ultraviolet radiation sources 160 and 210, a one light source system can be used. This is accomplished by providing an amount of solvent in the resin 132. The resin 132 must be dilutable by a solvent. Such a resin is acrylate. Then, instead of irradiating the resin with ultraviolet rays 162 from ultraviolet radiation source 160, a suction hose (in place of ultraviolet radiation source 160 on FIG. 2) can be used to collect and safely dispose of solvent fumes. As the solvent evaporates, the upper part 164 of the resin 132 becomes tack-free while the lower end 165 remains adhesive creating the label 170. After application of the label 170 to the package 190 as shown in FIGS. 1 and 2, a final exposure is accomplished by ultraviolet radiation source 210 to create the tamper evident label 211. This method is preferred when using the "off-line" cavity and preprinted label method described hereinabove with respect to FIGS. 7 and 8.

It will be appreciated that the present invention provides a method and an associated apparatus for applying a tamper evident label to a package. The method and apparatus also provides for the creation of different shapes and unique textures for the coating material.

It will be appreciated that the method may be employed with a wide variety of packages composed of various materials to which the material will adhere. For example, closures, blister packages, pouches, glass or plastic jars, bottles or metal or metal laminate containers may be processed with this material. Multiple passes of the package may be employed to effect coverage on several parts of the package.

It will be appreciated that the system may be employed to effect the treatment sequentially on a plurality of packages.

Whereas a particular embodiment has been described hereinabove, for purposes of illustration, it will be evident to those skilled in the art that numerous variations of the details may be made without departing from the invention as defined in the appended claims.

I claim:

1. A method of applying a tamper evident label to a package comprising the steps of:

providing a carrier tape having a plurality of recesses;

depositing a resin into said recesses;

treating said resin to produce a label having an adhesive portion;

separating said label from said carrier tape;

securing said adhesive portion to said package;

curing said label to create said tamper evident label on said package;

producing said label by partially curing said resin by exposing said resin to radiation;

effecting said curing of said label by exposing said label to radiation to produce said tamper evident label;

moving said carrier tape in a first direction before separation of said label from said carrier tape; and moving said carrier tape in a second direction to separate said label from said carrier tape for transfer of said label to said packages.

2. The method of claim 1, further including employing as the material for said carrier tape polyester, silicon or tetrafluorethylene.

3. The method of claim 2, further including said carrier tape forming a closed loop, whereby said carrier tape recesses can be refilled with resin after said label is secured to each package.

4. The method of claim 2, further including unwinding said carrier tape from a first spool;

moving said carrier tape over an idler roller; and taking up said carrier tape on a second spool.

* * * * *

UNITED STATES PATENT AND TRADEMARK OFFICE

CERTIFICATE OF CORRECTION

PATENT NO. : 5,028,290

DATED : July 2, 1991

INVENTOR(S) : YORAM CURIEL

It is certified that error appears in the above-identified patent and that said Letters Patent is hereby corrected as shown below:

Column 2, line 44, --tape-- should be inserted after "the".

Column 3, line 14, "10" should be --110--.

Signed and Sealed this

Twentieth Day of October, 1992

*Attest:*

DOUGLAS B. COMER

*Attesting Officer*

*Acting Commissioner of Patents and Trademarks*